US011045933B2

(12) United States Patent
Fransson et al.

(10) Patent No.: US 11,045,933 B2
(45) Date of Patent: Jun. 29, 2021

(54) DEVICE FOR INSERTING A TONGUE

(71) Applicant: Välinge Innovation AB, Viken (SE)

(72) Inventors: Jonas Fransson, Allerum (SE); Anders Aldsten, Hammenhög (SE)

(73) Assignee: VALINGE INNOVATION AB, Viken (SE)

( * ) Notice: Subject to any disclaimer, the term of this patent is extended or adjusted under 35 U.S.C. 154(b) by 201 days.

(21) Appl. No.: 16/311,224

(22) PCT Filed: Jun. 28, 2017

(86) PCT No.: PCT/SE2017/050711

§ 371 (c)(1),
(2) Date: Dec. 19, 2018

(87) PCT Pub. No.: WO2018/004435

PCT Pub. Date: Jan. 4, 2018

(65) Prior Publication Data

US 2019/0232473 A1 Aug. 1, 2019

(30) Foreign Application Priority Data

Jun. 30, 2016 (SE) ..... 1650955-6

(51) Int. Cl.
*B25B 27/02* (2006.01)
*B27M 3/00* (2006.01)
(Continued)

(52) U.S. Cl.
CPC ..... *B25B 27/02* (2013.01); *B25B 28/00* (2013.01); *B27M 3/0066* (2013.01); *B25B 23/06* (2013.01);
(Continued)

(58) Field of Classification Search
CPC ..... Y10T 29/53839; Y10T 29/53709; Y10T 29/5383; B23P 19/04; B23P 19/047;
(Continued)

(56) References Cited

U.S. PATENT DOCUMENTS 1,194,636 A 8/1916 Joy
1,687,522 A 10/1928 Staude
(Continued)

FOREIGN PATENT DOCUMENTS

BE 1 019 989 A3 3/2013
BE 1 020 211 A5 6/2013
(Continued)

OTHER PUBLICATIONS

Extended European Search Report dated Jan. 2, 2020 in EP 17820655.3, European Patent Office, Munich, DE, 14 pages.
(Continued)

*Primary Examiner* — Tyrone V Hall, Jr.
(74) *Attorney, Agent, or Firm* — Buchanan Ingersoll & Rooney P.C.

(57) ABSTRACT

A device for inserting a tongue into an insertion groove in a panel including a first part including a supporting surface configured to cooperate with an upper surface of a panel. The device includes a second part, which is connected to the first part, including a guiding device for a displaceable puncher which is configured to displace a tongue into an insertion groove of a panel. The supporting surface is extending in a first direction and the guiding device is extending in second direction.

18 Claims, 8 Drawing Sheets

(51) Int. Cl.

| | |
|---|---|
| ***B25B 28/00*** | (2006.01) |
| ***B27M 3/04*** | (2006.01) |
| ***E04F 15/02*** | (2006.01) |
| ***B25B 23/10*** | (2006.01) |
| ***B25B 23/06*** | (2006.01) |

(52) U.S. Cl.
CPC ..... *B25B 23/10* (2013.01); *B27M 3/04* (2013.01); *E04F 15/02038* (2013.01); *E04F 2201/0523* (2013.01); *E04F 2201/0547* (2013.01)

(58) Field of Classification Search
CPC ... B25B 27/02; B25B 27/0092; B25B 27/026; B25B 27/14; B25B 28/00; B27M 3/0066; E04F 21/22; E04F 15/02038; F16B 12/26
See application file for complete search history.

(56) References Cited

U.S. PATENT DOCUMENTS 1,902,716 A 3/1933 Newton
3,114,477 A 12/1963 Dixon
3,143,335 A * 8/1964 Lassahn ..... B25B 5/061 254/11
3,147,522 A 9/1964 Schumm
3,381,730 A 5/1968 Omholt
3,572,224 A 3/1971 Perry
3,579,941 A 5/1971 Tibbals
3,584,761 A 6/1971 Flanigan et al.
3,720,027 A 3/1973 Christensen
3,760,485 A 9/1973 Smith
3,760,547 A 9/1973 Brenneman
3,778,954 A 12/1973 Meserole
3,919,820 A 11/1975 Green
3,930,808 A 1/1976 Miller et al.
3,961,408 A 6/1976 Goodsmith
4,098,173 A 7/1978 Schauman
4,332,203 A * 6/1982 Flowers ..... E04F 21/22 105/422
4,648,165 A 3/1987 Whitehorne
4,899,438 A 2/1990 Muller et al.
5,105,980 A 4/1992 Hofmann
5,174,022 A 12/1992 Phillips et al.
5,388,721 A 2/1995 Mauer
5,582,611 A 12/1996 Tsuruta et al.
5,636,426 A 6/1997 Luckhardt et al.
5,810,239 A 9/1998 Stich
5,996,876 A 12/1999 Dickhoff et al.
6,098,442 A 8/2000 Walldorf et al.
6,273,315 B1 8/2001 McGuinness et al.
6,314,701 B1 11/2001 Meyerson
6,363,677 B1 4/2002 Chen et al.
6,385,936 B1 5/2002 Schneider
6,413,007 B1 7/2002 Lambright
6,418,683 B1 7/2002 Martensson et al.
6,446,413 B1 9/2002 Gruber
6,490,836 B1 12/2002 Moriau et al.
6,505,452 B1 1/2003 Hannig
6,592,015 B1 7/2003 Gostylla et al.
6,631,827 B2 10/2003 Goodsmith
6,647,690 B1 11/2003 Martensson
6,651,400 B1 11/2003 Murphy
6,655,573 B1 12/2003 Chang
6,763,643 B1 7/2004 Martensson
6,766,622 B1 7/2004 Thiers
6,769,835 B2 8/2004 Stridsman
6,804,926 B1 10/2004 Eisermann
6,807,719 B2 10/2004 Herr et al.
6,843,402 B2 * 1/2005 Sims ..... B25C 7/00 227/119
6,854,235 B2 2/2005 Martensson
6,880,307 B2 4/2005 Schwitte et al.
7,040,068 B2 5/2006 Moriau et al.
7,051,486 B2 5/2006 Pervan
7,188,456 B2 3/2007 Knauseder
7,255,256 B2 * 8/2007 McGee ..... B25C 1/041 227/119
7,344,057 B2 * 3/2008 Dion ..... B25C 1/008 227/140
7,451,578 B2 11/2008 Hannig
7,454,875 B2 11/2008 Pervan et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,896,571 B1 3/2011 Hannig et al.
7,908,815 B2 3/2011 Pervan et al.
7,908,816 B2 3/2011 Grafenauer
7,930,862 B2 4/2011 Bergelin et al.
7,980,041 B2 7/2011 Pervan
8,033,074 B2 10/2011 Pervan
8,042,311 B2 10/2011 Pervan
8,061,104 B2 11/2011 Pervan
8,061,248 B2 11/2011 Svensson
8,079,196 B2 12/2011 Pervan
8,091,238 B2 1/2012 Hannig
8,112,967 B2 2/2012 Pervan et al.
8,171,692 B2 5/2012 Pervan
8,181,416 B2 5/2012 Pervan et al.
8,234,830 B2 8/2012 Pervan et al.
8,256,104 B2 9/2012 Fulbright
8,302,367 B2 11/2012 Schulte
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,476 B2 2/2013 Hannig
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,738 B2 2/2014 Schulte
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,763,340 B2 7/2014 Pervan et al.
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
9,027,306 B2 5/2015 Pervan
9,051,738 B2 6/2015 Pervan et al.

(56) References Cited

U.S. PATENT DOCUMENTS 9,068,360 B2 6/2015 Pervan
9,091,077 B2 7/2015 Boo
9,120,141 B2 9/2015 Clew et al.
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan et al.
9,458,634 B2 10/2016 Derelov
9,482,012 B2 11/2016 Nygren et al.
9,540,826 B2 1/2017 Pervan et al.
9,555,529 B2 1/2017 Ronconi
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,856,656 B2 1/2018 Pervan
9,874,027 B2 1/2018 Pervan
9,945,130 B2 4/2018 Nygren et al.
9,951,526 B2 4/2018 Boo et al.
10,006,210 B2 6/2018 Pervan et al.
10,017,948 B2 7/2018 Boo
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,307,815 B2 6/2019 Badent et al.
10,352,049 B2 7/2019 Boo
10,358,830 B2 7/2019 Pervan
10,378,217 B2 8/2019 Pervan
10,458,125 B2 10/2019 Pervan
10,526,792 B2 1/2020 Pervan et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
10,724,251 B2 7/2020 Kell
10,731,358 B2 8/2020 Pervan
10,794,065 B2 10/2020 Boo et al.
10,828,798 B2 11/2020 Fransson
2002/0031646 A1 3/2002 Chen et al.
2002/0170259 A1 11/2002 Ferris
2002/0178674 A1 12/2002 Pervan
2003/0009971 A1 1/2003 Palmberg
2003/0024199 A1 2/2003 Pervan et al.
2003/0037504 A1 2/2003 Schwitte et al.
2003/0180091 A1 9/2003 Stridsman
2003/0188504 A1 10/2003 Ralf
2003/0196405 A1 10/2003 Pervan
2004/0016196 A1 1/2004 Pervan
2004/0031227 A1 2/2004 Knauseder
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0200175 A1 10/2004 Weber
2004/0211143 A1 10/2004 Hannig
2004/0244325 A1 12/2004 Nelson
2004/0261348 A1 12/2004 Vulin
2005/0081373 A1 4/2005 Seidler
2005/0160694 A1 7/2005 Pervan
2005/0205161 A1 9/2005 Lewark
2005/0210810 A1 9/2005 Pervan
2006/0070333 A1 4/2006 Pervan
2006/0101769 A1 5/2006 Pervan
2006/0162814 A1 7/2006 Symossek et al.
2006/0236642 A1 10/2006 Pervan
2006/0260254 A1 11/2006 Pervan et al.
2007/0006543 A1 1/2007 Engström
2007/0011981 A1 1/2007 Eiserman
2007/0028547 A1 2/2007 Grafenauer
2007/0151189 A1 7/2007 Yang et al.
2007/0175156 A1 8/2007 Pervan et al.
2007/0193178 A1 8/2007 Groeke et al.
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0133353 A1 5/2009 Pervan et al.
2009/0193748 A1 8/2009 Boo et al.
2010/0043333 A1 2/2010 Hannig et al.
2010/0218360 A1 9/2010 Mangone, Jr.
2010/0293879 A1 11/2010 Pervan et al.
2010/0300031 A1 12/2010 Pervan et al.
2010/0313714 A1 12/2010 Smith
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0088344 A1 4/2011 Pervan et al.
2011/0088345 A1 4/2011 Pervan
2011/0088346 A1 4/2011 Hannig
2011/0094083 A1 4/2011 Schulte
2011/0154763 A1 6/2011 Bergelin et al.
2011/0167750 A1 7/2011 Pervan
2011/0167751 A1 7/2011 Engström
2011/0225922 A1 9/2011 Pervan et al.
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0073235 A1 3/2012 Hannig
2012/0151865 A1 6/2012 Pervan et al.
2012/0174515 A1 7/2012 Pervan
2012/0174520 A1 7/2012 Pervan
2012/0279161 A1 11/2012 Håkansson et al.
2013/0008117 A1 1/2013 Pervan
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Pervan et al.

(56) References Cited

U.S. PATENT DOCUMENTS

| | | | |
|---|---|---|---|
| 2013/0263454 | A1 | 10/2013 | Boo et al. |
| 2013/0263547 | A1 | 10/2013 | Boo |
| 2013/0318906 | A1 | 12/2013 | Pervan et al. |
| 2014/0007539 | A1 | 1/2014 | Pervan et al. |
| 2014/0020324 | A1 | 1/2014 | Pervan |
| 2014/0033634 | A1 | 2/2014 | Pervan |
| 2014/0042203 | A1 | 2/2014 | Abe |
| 2014/0053497 | A1 | 2/2014 | Pervan et al. |
| 2014/0059966 | A1 | 3/2014 | Boo |
| 2014/0069043 | A1 | 3/2014 | Pervan |
| 2014/0090335 | A1 | 4/2014 | Pervan et al. |
| 2014/0109501 | A1 | 4/2014 | Pervan |
| 2014/0109506 | A1 | 4/2014 | Pervan et al. |
| 2014/0123586 | A1 | 5/2014 | Pervan et al. |
| 2014/0138422 | A1 | 5/2014 | Ronconi |
| 2014/0150369 | A1 | 6/2014 | Hannig |
| 2014/0190112 | A1 | 7/2014 | Pervan |
| 2014/0208677 | A1 | 7/2014 | Pervan et al. |
| 2014/0223852 | A1 | 8/2014 | Pervan |
| 2014/0237931 | A1 | 8/2014 | Pervan |
| 2014/0250813 | A1 | 9/2014 | Nygren et al. |
| 2014/0260060 | A1 | 9/2014 | Pervan et al. |
| 2014/0305065 | A1 | 10/2014 | Pervan |
| 2014/0338177 | A1 | 11/2014 | Vermeulen et al. |
| 2014/0366476 | A1 | 12/2014 | Pervan |
| 2014/0373478 | A2 | 12/2014 | Pervan et al. |
| 2014/0373480 | A1 | 12/2014 | Pervan et al. |
| 2015/0000221 | A1 | 1/2015 | Boo |
| 2015/0013260 | A1 | 1/2015 | Pervan |
| 2015/0059281 | A1 | 3/2015 | Pervan |
| 2015/0078819 | A1 | 3/2015 | Derelöv et al. |
| 2015/0089896 | A2 | 4/2015 | Pervan et al. |
| 2015/0121796 | A1 | 5/2015 | Pervan |
| 2015/0152644 | A1 | 6/2015 | Boo |
| 2015/0167318 | A1 | 6/2015 | Pervan |
| 2015/0211239 | A1 | 7/2015 | Pervan |
| 2015/0233125 | A1 | 8/2015 | Pervan et al. |
| 2015/0267419 | A1 | 9/2015 | Pervan |
| 2015/0300029 | A1 | 10/2015 | Pervan |
| 2015/0321325 | A1* | 11/2015 | Vandenberg ..... B25B 23/005 81/57.37 |
| 2015/0330088 | A1 | 11/2015 | Derelov |
| 2015/0336224 | A1 | 11/2015 | Liu et al. |
| 2015/0337537 | A1 | 11/2015 | Boo |
| 2016/0032596 | A1 | 2/2016 | Nygren et al. |
| 2016/0060879 | A1 | 3/2016 | Pervan |
| 2016/0069088 | A1 | 3/2016 | Boo et al. |
| 2016/0076260 | A1 | 3/2016 | Pervan et al. |
| 2016/0090744 | A1 | 3/2016 | Pervan et al. |
| 2016/0129573 | A1 | 5/2016 | Anstett et al. |
| 2016/0153200 | A1 | 6/2016 | Pervan |
| 2016/0168866 | A1 | 6/2016 | Pervan et al. |
| 2016/0186426 | A1 | 6/2016 | Boo |
| 2016/0194884 | A1 | 7/2016 | Pervan et al. |
| 2016/0201336 | A1 | 7/2016 | Pervan |
| 2016/0251859 | A1 | 9/2016 | Pervan et al. |
| 2016/0251860 | A1 | 9/2016 | Pervan |
| 2016/0281368 | A1 | 9/2016 | Pervan et al. |
| 2016/0281370 | A1 | 9/2016 | Pervan et al. |
| 2016/0326751 | A1 | 11/2016 | Pervan |
| 2016/0340913 | A1 | 11/2016 | Derelöv |
| 2017/0037641 | A1 | 2/2017 | Nygren et al. |
| 2017/0081860 | A1 | 3/2017 | Boo |
| 2017/0254096 | A1 | 9/2017 | Pervan |
| 2017/0321433 | A1 | 11/2017 | Pervan et al. |
| 2017/0362834 | A1 | 12/2017 | Pervan et al. |
| 2018/0001509 | A1 | 1/2018 | Myllykangas et al. |
| 2018/0001510 | A1 | 1/2018 | Fransson |
| 2018/0001573 | A1 | 1/2018 | Blomgren et al. |
| 2018/0002933 | A1 | 1/2018 | Pervan |
| 2018/0030737 | A1 | 2/2018 | Pervan |
| 2018/0030738 | A1 | 2/2018 | Pervan |
| 2018/0119431 | A1 | 5/2018 | Pervan et al. |
| 2018/0178406 | A1 | 6/2018 | Fransson et al. |
| 2019/0024387 | A1 | 1/2019 | Pervan et al. |
| 2019/0048592 | A1 | 2/2019 | Boo |
| 2019/0048596 | A1 | 2/2019 | Pervan |
| 2019/0063076 | A1 | 2/2019 | Boo et al. |
| 2019/0093370 | A1 | 3/2019 | Pervan et al. |
| 2019/0093371 | A1 | 3/2019 | Pervan |
| 2019/0119928 | A1 | 4/2019 | Pervan et al. |
| 2019/0127989 | A1 | 5/2019 | Kell |
| 2019/0127990 | A1 | 5/2019 | Pervan et al. |
| 2019/0169859 | A1 | 6/2019 | Pervan et al. |
| 2019/0271165 | A1 | 9/2019 | Boo |
| 2019/0376298 | A1 | 12/2019 | Pervan et al. |
| 2019/0394314 | A1 | 12/2019 | Pervan et al. |
| 2020/0087927 | A1 | 3/2020 | Pervan |
| 2020/0102756 | A1 | 4/2020 | Pervan |
| 2020/0109569 | A1 | 4/2020 | Pervan |
| 2020/0149289 | A1 | 5/2020 | Pervan |
| 2020/0173175 | A1 | 6/2020 | Pervan |
| 2020/0224430 | A1 | 7/2020 | Ylikangas et al. |
| 2020/0263437 | A1 | 8/2020 | Pervan |
| 2020/0284045 | A1 | 9/2020 | Kell |
| 2020/0318667 | A1 | 10/2020 | Derelöv |

FOREIGN PATENT DOCUMENTS

| | | | |
|---|---|---|---|
| BR | PI 0906645-4 | A2 | 9/2009 |
| DE | 25 05 489 | A1 | 8/1976 |
| DE | 197 52 286 | A1 | 5/1999 |
| DE | 202 05 774 | U1 | 8/2002 |
| DE | 203 20 799 | U1 | 4/2005 |
| DE | 10 2004 055 951 | A1 | 7/2005 |
| DE | 10 2004 062 648 | | 7/2006 |
| DE | 10 2006 057 491 | A1 | 6/2008 |
| EP | 0 974 713 | A1 | 1/2000 |
| EP | 1 420 125 | A2 | 5/2004 |
| EP | 1 650 375 | A1 | 4/2006 |
| EP | 1 674 223 | A1 | 6/2006 |
| EP | 1 650 375 | A8 | 9/2006 |
| EP | 1 674 223 | B1 | 7/2008 |
| EP | 2 395 179 | A2 | 12/2011 |
| EP | 2 276 614 | B1 | 9/2012 |
| EP | 2 689 904 | A1 | 1/2014 |
| EP | 2 732 923 | A2 | 5/2014 |
| EP | 2 774 735 | A1 | 9/2014 |
| EP | 2 732 923 | B1 | 1/2018 |
| EP | 3 354 909 | A1 | 8/2018 |
| GB | 240629 | | 10/1925 |
| GB | 376352 | | 7/1932 |
| GB | 1171337 | | 11/1969 |
| SE | 529 076 | C2 | 4/2007 |
| WO | WO 94/26999 | A1 | 11/1994 |
| WO | WO 96/27721 | A1 | 9/1996 |
| WO | WO 97/47834 | A1 | 12/1997 |
| WO | WO 00/20705 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/51732 | A1 | 7/2001 |
| WO | WO 01/75247 | A1 | 10/2001 |
| WO | WO 01/98604 | A1 | 12/2001 |
| WO | WO 03/016654 | A1 | 2/2003 |
| WO | WO 03/044303 | A1 | 5/2003 |
| WO | WO 03/083234 | A1 | 10/2003 |
| WO | WO 03/087497 | A1 | 10/2003 |
| WO | WO 2004/016877 | A1 | 2/2004 |
| WO | WO 2004/020764 | A1 | 3/2004 |
| WO | WO 2004/085765 | A1 | 10/2004 |
| WO | WO 2005/054599 | A1 | 6/2005 |
| WO | WO 2006/043893 | A1 | 4/2006 |
| WO | WO 2006/104436 | A1 | 10/2006 |
| WO | WO 2007/015669 | A2 | 2/2007 |
| WO | WO 2007/015669 | A3 | 2/2007 |
| WO | WO 2007/079845 | A1 | 7/2007 |
| WO | WO 2007/109787 | A2 | 9/2007 |
| WO | WO 2008/017301 | A2 | 2/2008 |
| WO | WO 2008/017301 | A3 | 2/2008 |
| WO | WO 2008/068245 | A1 | 6/2008 |

(56) References Cited

FOREIGN PATENT DOCUMENTS

| | | | |
|---|---|---|---|
| WO | WO 2009/116926 | A1 | 9/2009 |
| WO | WO 2009/124517 | A1 | 10/2009 |
| WO | WO 2010/001262 | A2 | 1/2010 |
| WO | WO 2010/087752 | A1 | 8/2010 |
| WO | WO 2012/154113 | A1 | 11/2012 |
| WO | WO 2013/025164 | A1 | 2/2013 |
| WO | WO 2013/025165 | A1 | 2/2013 |
| WO | WO 2013/037904 | A1 | 3/2013 |
| WO | WO 2015/038059 | A1 | 3/2015 |
| WO | WO 2015/105451 | A1 | 7/2015 |
| WO | WO 2015/133768 | A1 | 9/2015 |
| WO | WO 2017/135874 | A1 | 8/2017 |

OTHER PUBLICATIONS

Extended European Search Report dated Dec. 9, 2019 in EP 17820656.1, European Patent Office, Munich, DE, 10 pages.
Extended European Search Report dated Jan. 30, 2020 in EP 17820652.0, European Patent Office, Munich, DE, 10 pages.
U.S. Appl. No. 16/839,657, filed Apr. 3, 2020, Derelöv.
Extended European Search Report dated Apr. 2, 2020 in EP 17820657.9, European Patent Office, Munich, DE, 4 pages.
**Derelöv, Peter, U.S. Appl. No. 16/839,657, entitled "Automated Assembly," filed in the U.S. Patent and Trademark Office Apr. 3, 2020.
U.S. Appl. No. 15/635,379, Fredrik Myllykangas and Jonas Fransson, filed Jun. 28, 2017 (Cited herein as U.S. Patent Application Publication No. 2018/0001509 A1 of Jan. 4, 2018).
U.S. Appl. No. 15/635,532, Jonas Fransson, filed Jun. 28, 2017 (Cited herein as U.S. Patent Application Publication No. 2018/0001510 A1 of Jan. 4, 2018).
U.S. Appl. No. 15/635,619, Andreas Blomgren and Jonas Fransson, filed Jun. 28, 2017 (Cited herein as U.S. Patent Application Publication No. 2018/0001573 A1 of Jan. 4, 2018).
U.S. Appl. No. 15/848,164, Jonas Fransson, Andreas Blomgren and Karl Erikson, filed Dec. 20, 2017 (Cited herein as U.S. Patent Application Publication No. 2018/0178406 A1 of Jun. 28, 2018).
International Search Report and Written Opinion issued in PCT/SE2017/050718, dated Sep. 15, 2017, 11 pages, ISA/SE, Patent-och registreringsverket, Stockholm, SE.
International Search Report and Written Opinion issued in PCT/SE2017/050716, dated Sep. 15, 2017, 10 pages, ISA/SE, Patent-och registreringsverket, Stockholm, SE.
International Search Report and Written Opinion issued in PCT/SE2017/050717, dated Sep. 19, 2017, 13 pages, ISA/SE, Patent-och registreringsverket, Stockholm, SE.
International Search Report and Written Opinion issued in PCT/SE2017/050711, dated Sep. 19, 2017, 12 pages, SA/SE, Patent-och registreringsverket, Stockholm, SE.
International Search Report and Written Opinion issued in PCT/SE2017/051305, dated Mar. 5, 2018, 12 pages, ISA/SE, Patent-och registreringsverket, Stockholm, SE.
Extended European Search Report dated Jul. 22, 2020 in EP 17883594.8, European Patent Office, Munich, DE, 5 pages.
International Search Report and Written Opinion issued in PCT/EP2020/059600, dated Jul. 7, 2020, 14 pages, ISA/SE, European Patent Office, Rijswijk, NL.
Extended European Search Report dated Oct. 15, 2019 in EP 19167502.4, European Patent Office, Munich, DE, 6 pages.
**Fransson, Jonas, U.S. Appl. No. 17/060,325, entitled "Method and Device for Inserting a Tongue," filed in the U.S. Patent and Trademark Office Oct. 1, 2020.

* cited by examiner

DEVICE FOR INSERTING A TONGUE

FIELD OF THE INVENTION

Embodiments of the present invention relate to methods and devices for inserting a tongue into an insertion groove in a panel. The panel is configured to be arranged and locked perpendicular to an adjacent panel by a locking device comprising the tongue. The panels may be assembled and locked together to obtain a furniture product, such as a bookshelf, a cupboard, a wardrobe, a box, a drawer or a furniture component.

BACKGROUND OF THE INVENTION

A conventional furniture product may be assembled by a plurality of elements or panels. The panels may be assembled with a mechanical locking device, such as disclosed in, for example, WO 2012/154113 A1, The product comprises a first panel connected perpendicularly to a second panel by a mechanical locking device comprising, an edge tongue at the first panel, an edge groove at the second panel and a flexible tongue in an insertion groove.

WO2015038059 discloses a product assembled by a plurality of panels that are looked by mechanical locking devices comprising a flexible tongue in an insertion groove.

The locking devices of the panels are generally produced n a production line by a continuous production process, comprising a number of milling tools. The edge groove and the insertion groove may extend contiguously from a front edge to a back edge of the panel. The edge groove is preferably covered at the front edge by a decorative layer. The edge groove and the insertion groove may also end before the front edge and/or the back edge as disclosed in e.g. SE 1650135-5.

Embodiments of the present invention address a need to provide an improved device for inserting a tongue into an insertion groove in a panel.

SUMMARY OF THE INVENTION

Accordingly embodiments of the present invention preferably seek to mitigate, alleviate or eliminate one or more deficiencies, disadvantages or issues in the art, such as above-identified, singly or in any combination by providing a device for inserting a tongue in an it groove of a panel. The device is preferably handheld or configured to be attached to an assembling table.

A further object of embodiments of the invention is to provide a device with great flexibility which is suitable for short series production.

At least some of these and other objects and advantages that will be apparent from the description have been achieved by an aspect of the invention comprising a device for inserting a tongue into an insertion groove in a panel. The device comprises a first part comprising a supporting surface configured to directly cooperate with an upper surface of a panel, such that the supporting surface is positioned relative the upper surface of the panel. The device comprises a second part, which is connected to, the first part. The second part comprise a displaceable puncher and a guiding device which is configured to guide the puncher. The puncher is configured to displace a tongue into an insertion groove of a panel.

The supporting surface may extend in a first direction and the guiding device may extend in second direction. The first direction is preferably different from the second direction.

The device may comprise a handle 50 and may be configured to be handheld.

The handle may comprise a trigger for activating a stroke of the displaceable puncher.

The device may comprise an attachment device and the device may be configured to be attached to a holding fixture or an assembling table by the attachment device.

The displaceable puncher may be displaceable in the second direction.

A first angle which is between the first direction and the second direction may be in the range of about 10° to about 90° preferably in the range of about 10° to about 45°, or is about 25°.

The device may comprise a first adjusting device for setting the first angle.

The second part may comprise a structural part and a second adjusting device for setting a position of the guiding device relative the structural part in the second direction.

The first part may comprise a positioning element for positioning the first part relative the insertion groove in the first direction. A centre of gravity of the device is preferably adjacent or at the positioning element such that the device is easy to handle and to position in the correct position. This may be an advantage particularly for a handheld embodiment of the device.

The first part may comprise a third adjusting device for setting a position of the positioning element relative the first part in the first direction.

The second part may comprise a magazine for two or more of said tongue.

The magazine may be configured for storing a second of said tongue above a first of said tongue wherein the magazine is extending essentially perpendicular to the second direction.

The second part may comprise a power unit driving the puncher during a punch for the insertion of the tongue in the insertion groove.

The groove is of an elongated shape and is extending with a length direction along the upper surface of the panel, preferably along an edge of the panel.

The tongue may be of an elongated shape and a length direction of the tongue may be parallel with the length direction of the insertion groove.

The tongue may be of an elongated shape and a length direction of the tongue may be perpendicular to a displacement direction of the displaceable puncher.

The tongue may be of an elongated shape may comprise a first tong edge and a second-long edge. The first edge may be a first short edge, and the second edge may be an opposite second short edge.

A longitudinal direction of the tongue is preferably parallel to an axis of rotation of the rotatable/rotating tool.

The tongue may be a flexible tongue and made of, e.g., a polymer and preferably comprising a reinforcement material, such as a fibre e.g. glasfiber.

The tongue may comprise a bendable part at the first long edge and preferably a groove adjacent the bendable part. The bendable part may be configured to be pushed into the groove adjacent the bendable part. The tongue may comprise several of said bendable part and preferably several of said groove.

The tongue may comprise a polymer material and is preferably produced by injection moulding.

The tongue may be connected to several tongues in the tongue blank by a first rail at the first short edge and preferably by a second rail at the second short edge.

The first rail and the second rail may extend in length direction perpendicular to the tongue.

The tongue may be connected to the first rail and/or the second rail, which may be casting gates, by a first and a second casting gate, respectively.

The tongue is preferably configured to be displaceable in the insertion groove.

The device is preferably a part of a production line comprising milling tools for forming a locking device at the edge of the panel. The locking device preferably comprises said insertion groove.

The edge groove and the insertion groove may extend contiguously front edge to a back edge of the panel.

BRIEF DESCRIPTION OF THE DRAWINGS

These and other aspects, features and advantages of which embodiments of the invention are capable of will be apparent and elucidated from the follow description of embodiments of the present invention, reference being made to the accompanying drawings, in which.

DESCRIPTION OF EMBODIMENTS

Figure 1:
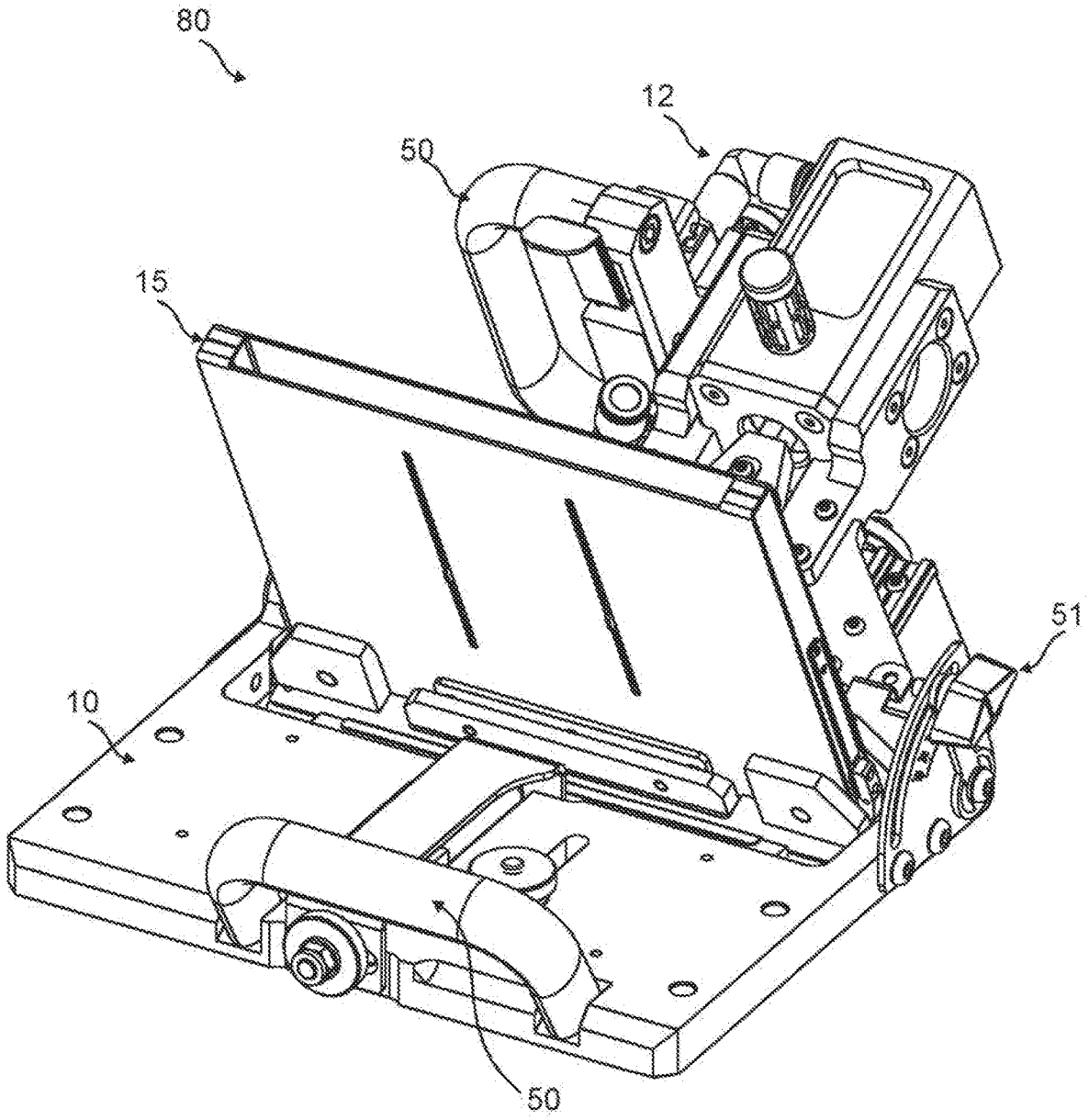
FIG. 1 shows in a 3D-view an embodiment device according to an embodiment of the invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

An embodiment of the device is shown in FIG. 1 to FIG. 5. FIG. 1 that may improve an insertion of a tongue in an insertion groove of a panel.

Figure 3:
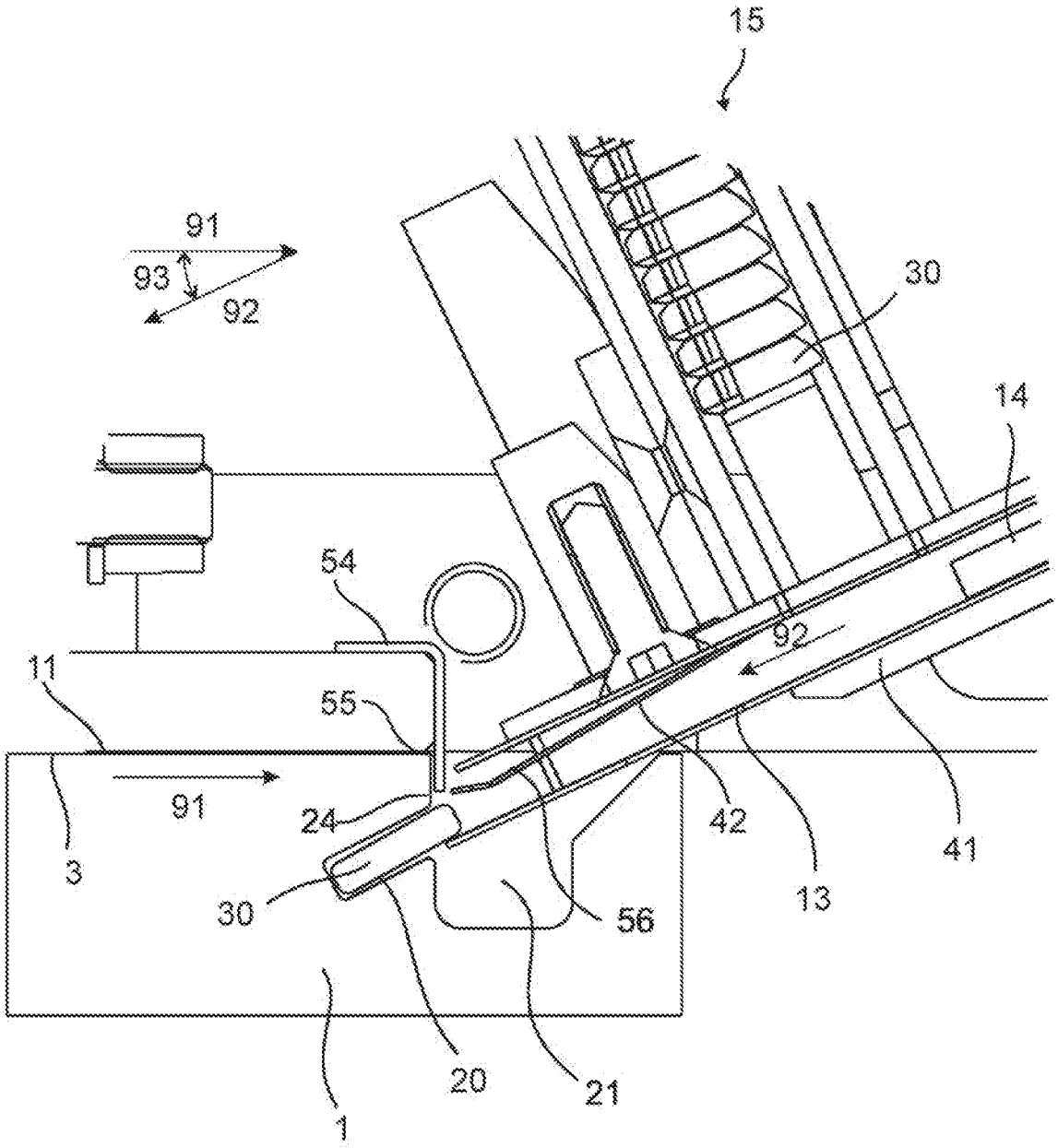
FIG. 3 shows an enlargement of parts of the embodiment of the device, shown in FIG. 2 according to an embodiment of the invention.

An embodiment of the device 80 is shown in a 3D-view, the device 80 for inserting a tongue 30 into an insertion groove 20 a panel 1, see FIG. 3. The device comprises a first part 10 comprising a supporting surface and the first part is connected to a second part 12. The device may comprise a first adjusting device 51 for setting an angle between the first and the second part. Each of the first and the second part may comprise a handle 50 and the second part may comprise a magazine for two or more of said tongue 30. The device may be configured to be handheld and the handle may comprise a trigger. The device may comprise an attachment device (not shown) and may be configured to be attached to a holding fixture or an assembling table by the attachment device.

Figure 2:
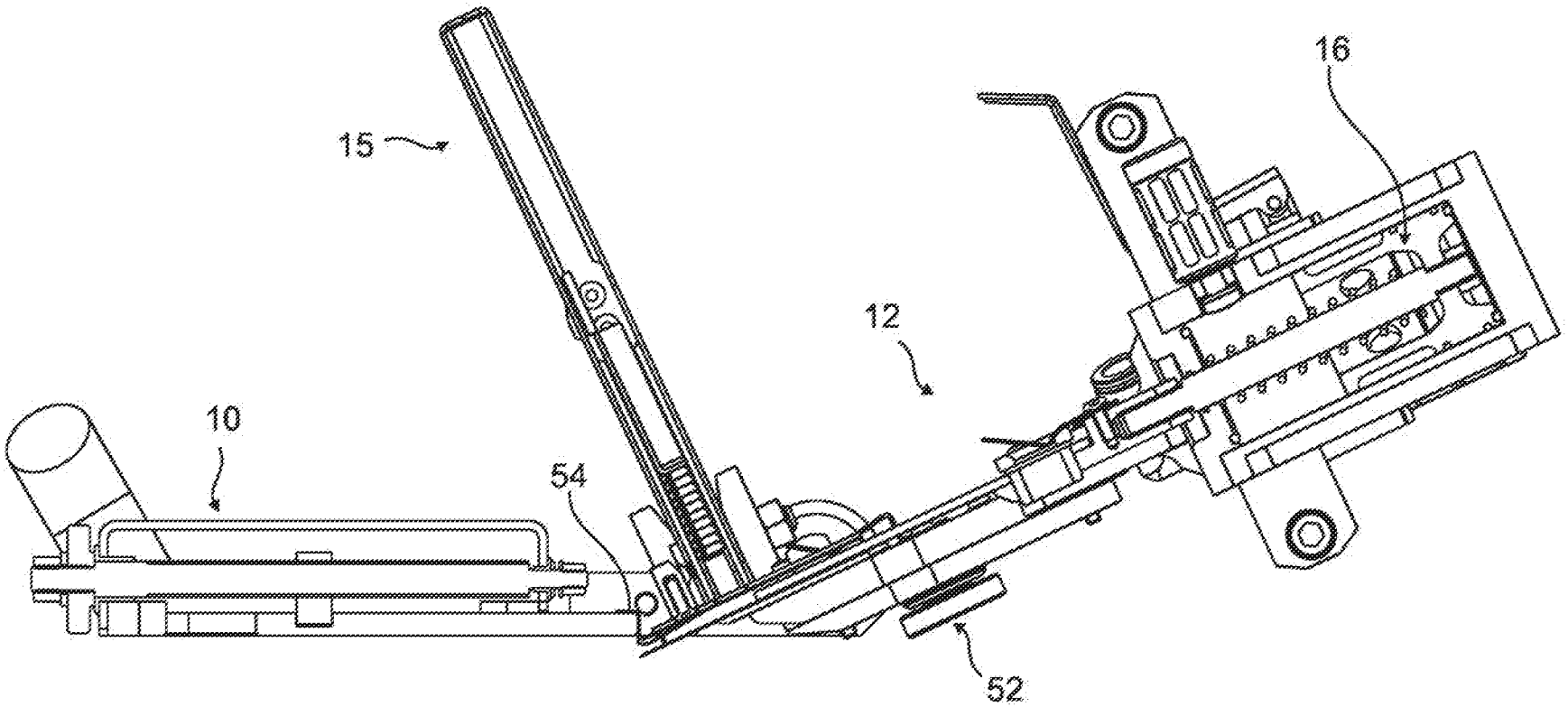
FIG. 2 shows a crosscut in a side view of an embodiment of the device according to an embodiment of the invention.

The embodiment shown FIG. 2 in a crosscut in a side view, comprises a power unit 18 for driving a puncher 14 during a punch for the insertion of the tongue 30 in the insertion groove 20. The magazine 15 may extend essentially perpendicular to the second part 12.

FIG. 3 shows an enlargement of some of the parts shown in FIG. 2. The first art 12 comprising a supporting surface 11 configured to directly cooperate with an upper surface 3 of a panel 1, such that the supporting surface and the device are positioned relative the upper surface of the panel, and the second part comprise a displaceable puncher 14 and a guiding device 13 which is configured to guide the displaceable puncher 14. The displaceable puncher 14 is configured to displace a tongue 30 into an insertion groove 20 of the panel 1.

The cooperation between the supporting surface and the upper surface of the panel may have the advantage that the device is positioned relative the insertion groove with great precision.

The weight of the device may press the supporting surface to the panel surface or for e.g. an embodiment of the device which is attached to a holding structure the panel may be pressed the supporting surface.

The supporting surface 11 is extending in a first direction 91 and the guiding device 13 is extending in second direction 92. The displaceable puncher 13 may be displaceable in the second direction 92.

The first part 10 preferably comprises a positioning element 54 for positioning the first part relative the insertion groove in the first direction 91. A centre of gravity of the device is preferably adjacent or at the positioning element such that the device is easy to handle and to position in the correct position. This may be an advantage particularly for a handheld embodiment of the device.

A surface 55 of the positioning element may be configured to cooperate with an edge surface 14 of the panel.

A first angle 93, which is between the first direction 91 and the second direction 92, may be in the range of about 10° to about 90°, preferably in the range of about 10° to about 45°, or may be about 25°. The device may comprise a first adjusting device 51, see FIG. 1, for setting the first angle 93.

The second part 12 may comprise a magazine 15 for two or more of said tongue 30. The magazine may be configured for storing a second of said tongue above a first said tongue and the magazine 15 may be extending essentially perpendicular to the second direction 15.

The guiding device 13 may comprise a flexible guiding element 56 at an outer part of the guiding device. The flexible guiding element is configured to guide the tongue 30 into the insertion groove 20.

The insertion groove 20 may be of an elongated shape and may be extend with a length direction along the upper surface of the panel.

The tongue 30 may be of an elongated shape and length direction of the tongue may be parallel with the length direction of the insertion groove 20.

The tongue 30 may be of an elongated shape and a length direction of the tongue may be perpendicular to a displacement direction of the displaceable puncher 14.

The second part 12 may comprise a structural part 41 and a second adjusting 52 device, see FIG. 2. The guiding device 13 may be attached to the structural part 41 and the second adjusting 52 device may be configured for setting a position of the guiding device 13 relative the structural part 41 in the second direction 92.

Figure 4:
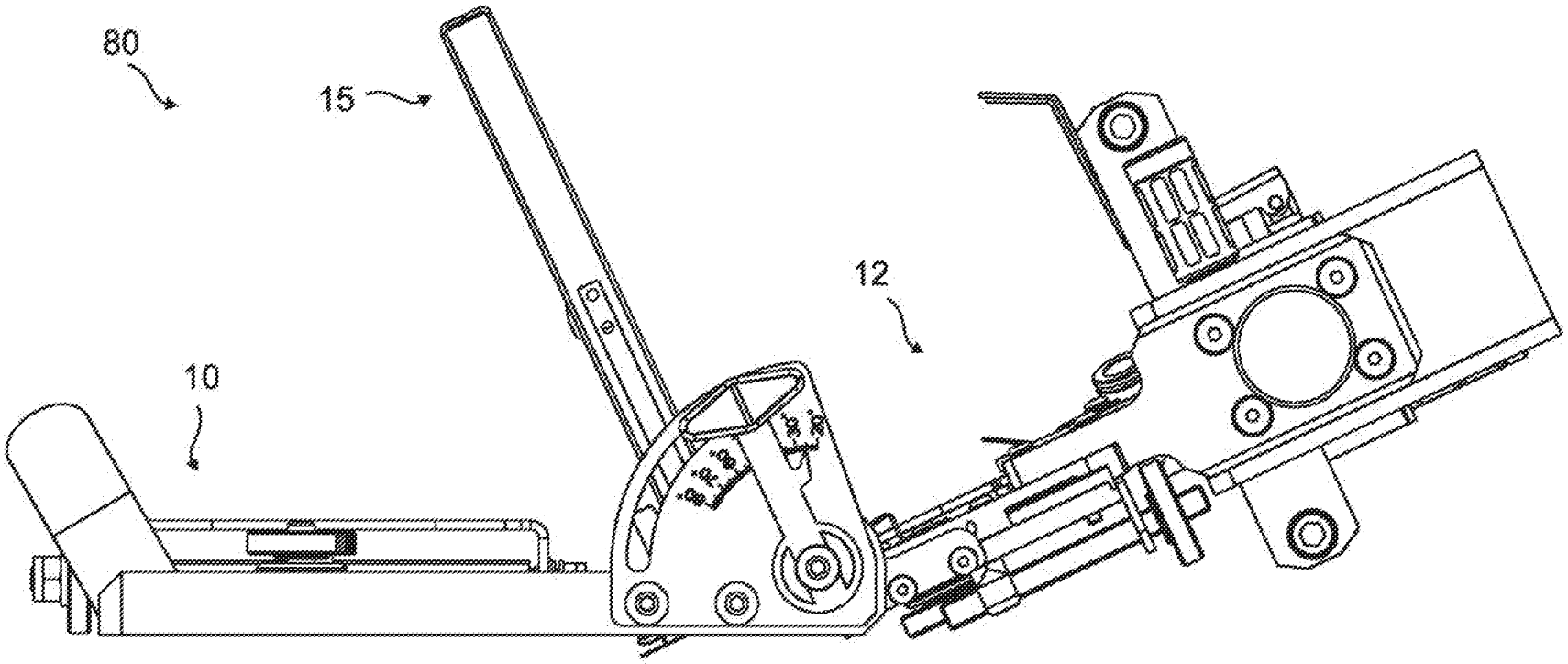
FIG. 4 shows in a side view of an embodiment of the device according to an embodiment of the invention.

FIG. 4 shows air embodiment of the device 80 in a side view comprising the first part 10 the second part 12 and the magazine 15.

Figure 5:
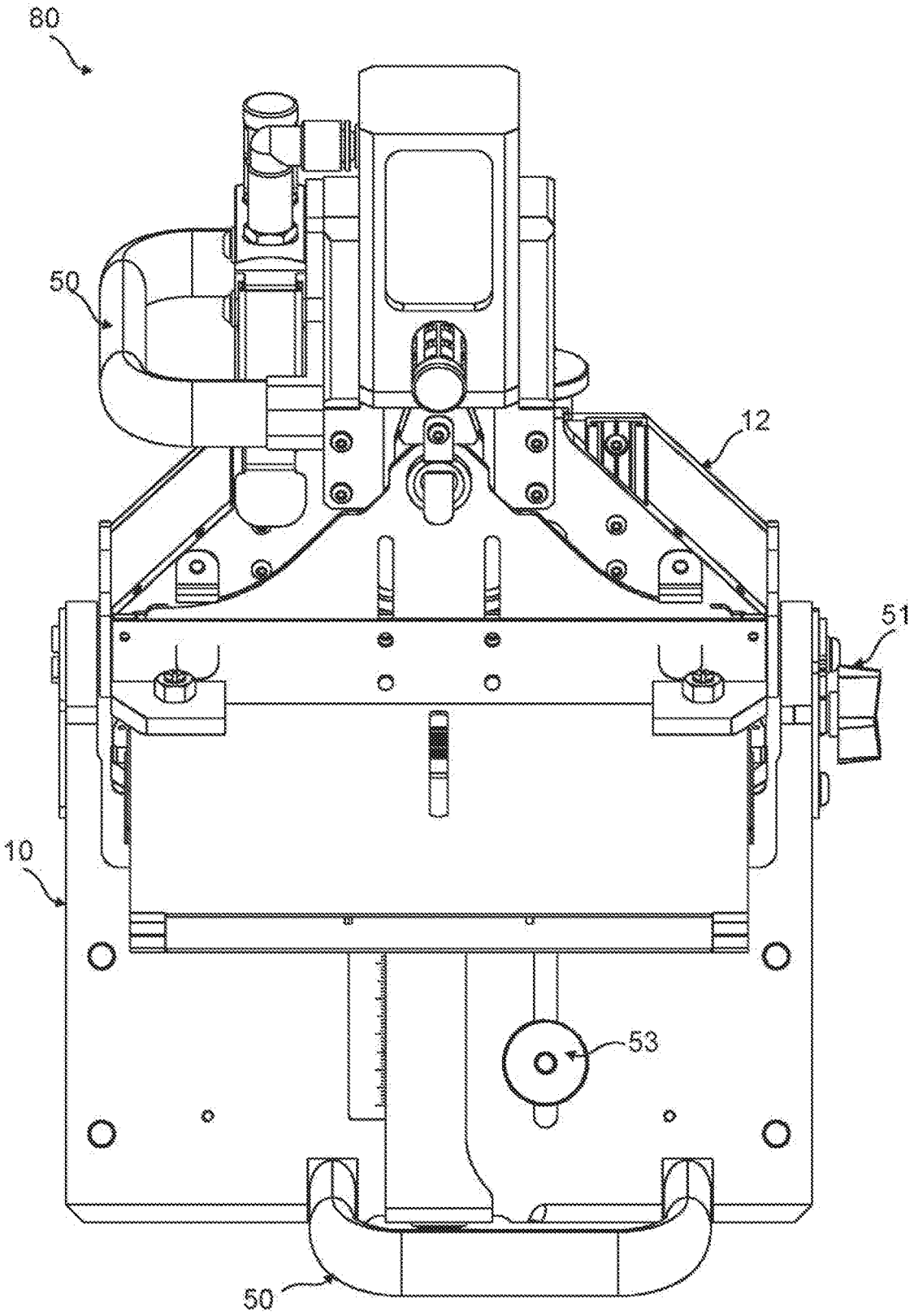
FIG. 5 shows in a top view an embodiment of the device according to an embodiment of the invention.

FIG. 5 shows a top view of the embodiment of the device. The fist part 10 of the device may comprise a third adjusting device 53 for setting a position of the positioning element 54 relative the first part 10 in the first direction 91.

An embodiment of the device comprising the first, the second and the third adjustment devices may be an advantage if the device is intended to be used for inserting tongues in insertion grooves and panels of different shapes. However, embodiment which intended to be used for inserting tongues in a more limited variety of shapes may lack one or more of the adjustment devices.

Figure 6A:
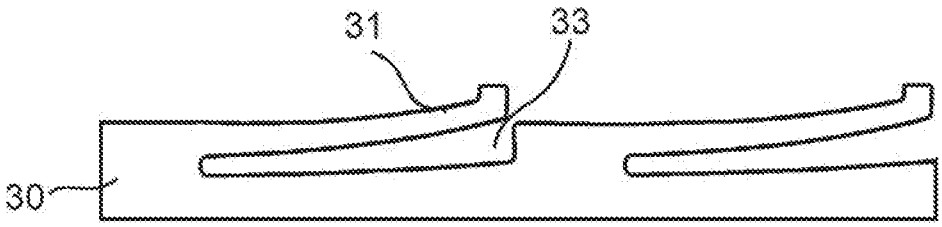
FIGS. 6A-6D show embodiments of the tongue according to embodiments of the invention.
Figure 6B:
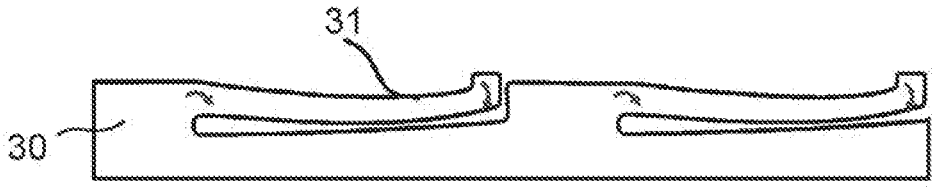
Figure 6C:
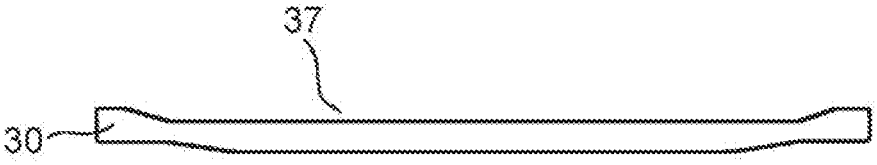
Figure 6D:
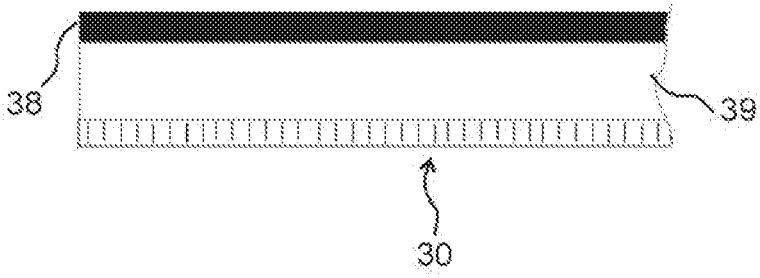

Embodiments of the tongue 30, which may be displaceable in an insertion groove 20 see FIGS. 8A-8D, is shown in FIGS. 6A-6D. A first embodiment of the tongue, which is shown in FIG. 6A-68, comprises bendable protruding parts 31 at a first long edge of the tongue. The first embodiment is shown in a relaxed state in FIG. 6A and in a compressed state in FIG. 6B A second long edge of the tongue is preferably essentially straight. The first embodiment may be inserted into the insertion groove with the bendable protruding parts facing towards a bottom of the insertion groove and the second edge extending beyond an opening of the insertion groove. A second embodiment of the tongue, which is shown in FIG. 6C in a relaxed state, is of an elongated shape and flexible. The second embodiment comprises a recess 37 at a first long edge of the tongue and a second edge which is essentially straight. The recess is decreased in a compressed state of the second embodiment. The second embodiment may be inserted into the insertion groove with the recess 37 facing towards a bottom of the insertion groove and the second edge extending beyond an opening of the insertion groove. A third embodiment of the tongue, which is shown in FIG. 6D, comprises a first part 37, which is flexible and configured to be compressed, and a second part which is rigid. The first, part may be arranged in the insertion groove and the second part may partly extend beyond ab opening of the insertion groove.

The tongue may be or as any of the embodiments of the displaceable tongue disclosed in, e.g., WO2006/043893 and WO2007/015689, the entire contents of which are hereby expressly incorporated by reference.

The tongue may be flexible and made of, e.g., a polymer and preferably comprising a reinforcement material, such as a fibre e.g. glasfiber.

Figure 7A:
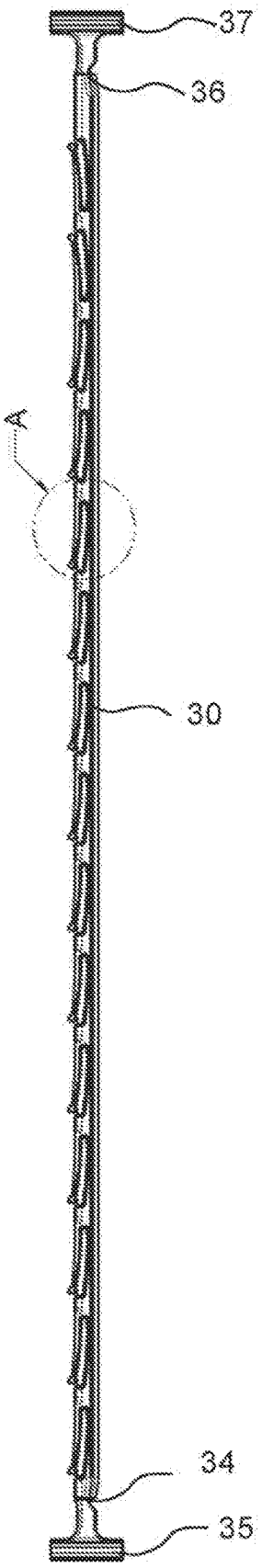
FIGS. 7A-7D show embodiment of the tongue according to an embodiment of the invention.
Figure 7B:
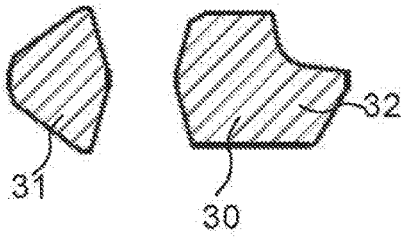
Figure 7C:
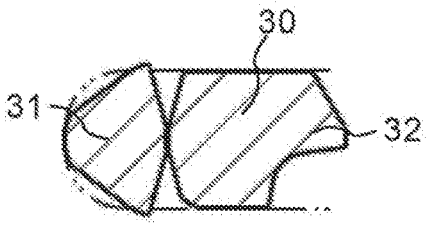
Figure 7D:
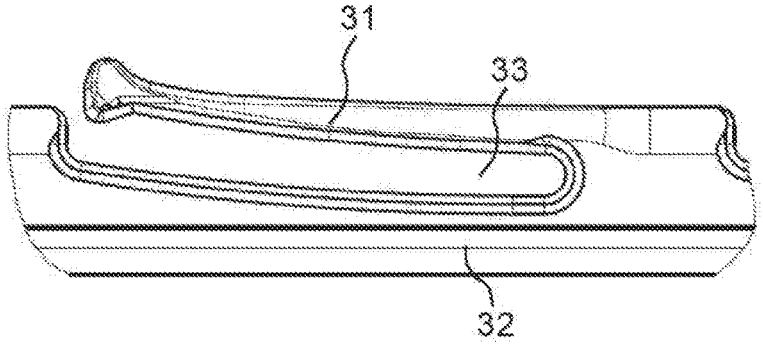

Another embodiment of the tongue 30 is shown in FIGS. 7A-D. The tongue is of an elongated shape and comprises a first short edge 34, an opposite second short edge 36, first long edge and a second long edge 32. FIG. 7D shows an enlargement of the encircled area A indicated in FIG. 7A. The tongue comprises several bendable parts 31 at the first long edge and a groove 33 at each bendable part 31. The tongue comprises a polymer material and is preferably produced by injection moulding. The bendable part 31 is configured to be pushed into the groove 34 in a compressed state of the tongue.

FIG. 7A shows an embodiment of tongue which is connected to several tongues (not shown) in a tongue blank by a first rail 35 at the first short edge 34 and by a second rail 37 at the second short edge 36. The first rail and the second rail is extending in a length direction perpendicular to the tongue. The tongue may be connected to the first rail and/or the second rail, which may be casting gates, by a first and a second casting gate, respectively. The tongues are separated from the first and/or the second rail before a stacking in magazine configured to be attached to the device.

FIG. 7B and FIG. 7C show the tongue 30 in a cross cut view. The tongue is in FIG. 4B in a relaxed state and in FIG. 4C in a compressed state. A distance between an outer part of the bendable part 31 and the second long edge 32 is shorter in the compressed state compared to in the relaxed state.

The tongue is preferably configured to be inserted into an insertion groove of a panel for locking the panel to an adjacent panel.

Figure 8A:
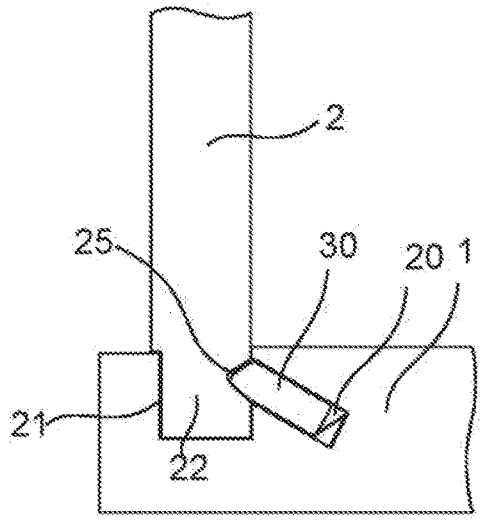
FIGS. 8A-8D show embodiments of the panel according to embodiments of the invention.

FIGS. 8A-5D shows embodiments of the panel 1, each comprising an embodiment of the tongue 30 inserted in an embodiment of the insertion groove 20, connected to an adjacent panel 2. The embodiments of the panel shown in FIGS. 8A-8D may be furniture panels. The embodiment of the panel shown in FIG. 8C may also be a floor panel.

FIG. 8A shows the panel 1 arranged perpendicular to an adjacent panel 2 and locked to the adjacent panel in a first direction and in a second direction, which is perpendicular to the first direction. The panel comprising an edge groove 2 at an upper surface of the panel. The edge groove 22 is of a longitudinal shape and is extending along an edge of the panel 1. The edge groove comprising said insertion, groove 20, which is extending along the edge groove, comprising said tongue 30. The adjacent panel comprises an edge tongue 22 which comprises a tongue groove 25 extending along an edge of the adjacent panel. The tongue 30 is configured to cooperate with the tongue groove 25 for locking together the panel 1 with the adjacent panel 2 in the first direction. The edge tongue 22 is configured to cooperate with the edge groove 21 for locking together the panel 1 with the adjacent panel 2 in the second direction.

Figure 8B:
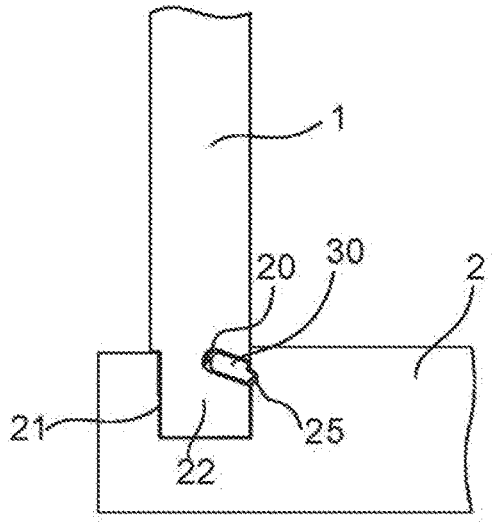

FIG. 8B shows the panel 1 arranged perpendicular to an adjacent panel 2 and locked to the adjacent panel in a first direction and in a second direction, which is perpendicular to the first direction. The adjacent panel comprising an edge groove 21 at an upper surface of the adjacent panel. The edge groove 22 is of a longitudinal shape and is extending along an edge of the adjacent panel 1. The edge groove comprises a tongue groove 25. The panel comprises an edge tongue 22 which comprises said insertion groove 20 comprising said tongue 30. The insertion groove is extending along the edge tongue. The tongue 30 is configured to cooperate with the tongue groove 25 for locking together the panel 1 with the adjacent panel 2 in the first direction. The edge tongue 22 is configured to cooperate with the edge groove 21 for locking together the panel 1 with the adjacent panel 2 in the second direction.

Figure 8C:
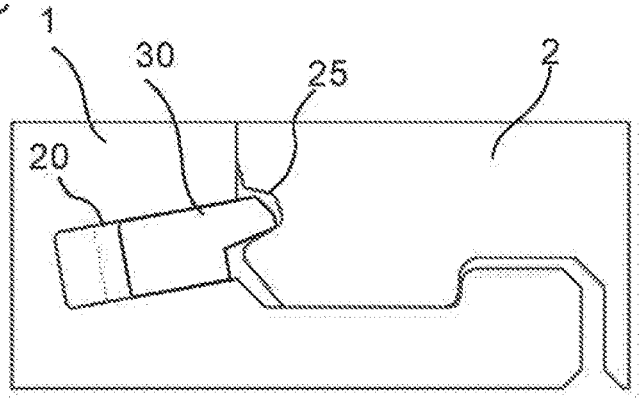

FIG. 8C shows the panel 1 arranged parallel to an adjacent panel 2 and locked to the adjacent panel in a first direction and in a second direction, which is perpendicular to the first direction. The panel comprising said insertion groove 20 which is extending along an edge of the panel. The edge comprises a strip protruding from the edge and the strip comprises an upwardly protruding locking element. The adjacent panel 2 comprises a tongue groove 25 extending along an adjacent edge of the adjacent panel 2. The adjacent edge comprises a locking groove with an opening facing downwards. The tongue 30 is configured to cooperate with the tongue groove 25 for locking the panel to the adjacent panel in a first direction and the locking element is configured to cooperate with the locking groove for locking the panel to the adjacent panel in the second direction. An embodiment of the said first and second panel comprises the insertion groove 20 at the adjacent edge of the adjacent panel and the tongue groove 25 at the edge of the panel.

Figure 8D:
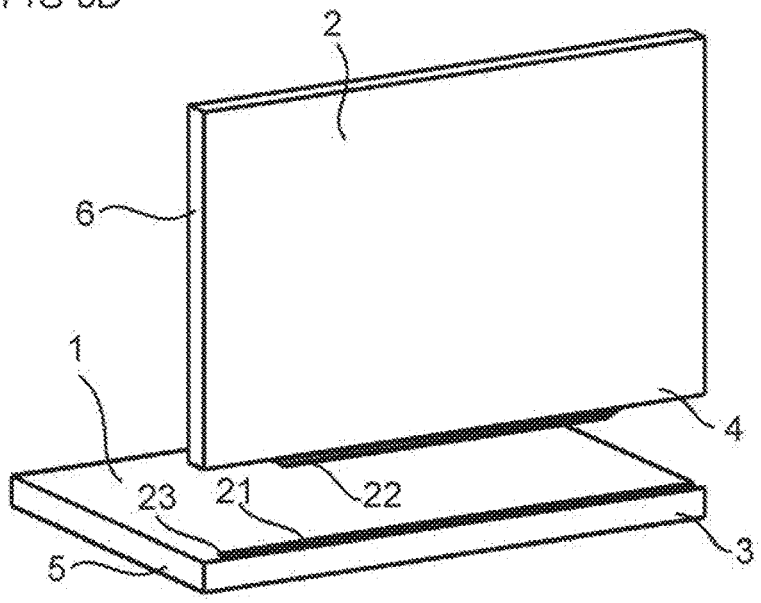

FIG. 8D shows an embodiment of the panel and the adjacent panel shown in FIG. 8A in a 3D-view. The edge tongue 22 is extending along the edge 4 of the adjacent panel and ends before an adjacent edge 6 of the adjacent panel 2. The edge groove 21 is extending along the edge 3 of the panel 1 and ends at a side wall 23 before an adjacent edge of the 5 of the panel 1.

A core material of embodiments of the panel and the adjacent panel described above may comprises a wood fibre based board, such as a HDF, MDF, plywood, solid wood or particleboard, or a reinforced plastic board or a wood fibre composite board. The core may be provided with a decorative layer.

The invention claimed is:

1. A device for inserting a tongue into an insertion groove in a panel, wherein the device comprises a first part comprising a supporting surface configured to directly cooperate with an upper surface of a panel, such that the supporting surface is positioned relative the upper surface of the panel, wherein the device comprises a second part, which is connected to the first part, wherein the second part comprises a displaceable puncher and a guiding device which is configured to guide the displaceable puncher, and wherein the displaceable puncher is configured to displace a tongue into an insertion groove of the panel, through an opening in the supporting surface, wherein the supporting surface is extending in a first direction and the guiding device is extending in a second direction, the first direction and the second direction forming a nonzero first angle.

2. The device as claimed in claim 1, wherein the device comprises a handle and is configured to be handheld.

3. The device as claimed in claim 2, wherein the handle comprises a trigger for activating a stroke of the displaceable puncher.

4. The device as claimed in claim 1, wherein the device comprises an attachment device and is configured to be attached to a holding fixture or an assembling table.

5. The device as claimed in claim 1, wherein the displaceable puncher is displaceable in the second direction.

6. The device as claimed in claim 1, wherein the first angle is in the range of about 10° to about 90°.

7. The device as claimed in claim 6, wherein the device comprises a first adjusting device for setting the first angle.

8. The device as claimed in claim 1, wherein the second part comprises a structural part, wherein the guiding device is attached to the structural part, wherein the second part comprises a second adjusting device for setting a position of the guiding device relative the structural part in the second direction.

9. The device as claimed in claim 1, wherein the first part comprises a positioning element for positioning the first part relative the insertion groove in the first direction.

10. The device as claimed in claim 9, wherein the first part comprises a third adjusting device for setting a position of the positioning element relative the first part in the first direction.

11. The device as claimed in claim 1, wherein the second part comprises a magazine for two or more of said tongue.

12. The device as claimed in claim 11, wherein the magazine is configured for storing a second of said tongue above a first said tongue, wherein the magazine is extending essentially perpendicular to the second direction.

13. The device as claimed in claim 1, wherein the second part comprises a power unit for driving the puncher during a punch for the insertion of the tongue in the insertion groove.

14. The device as claimed in claim 1, wherein the insertion groove is of an elongated shape and is configured to extend with a length direction along the upper surface of the panel when the panel is arranged such that the supporting surface of the first part directly cooperates with the upper surface of the panel.

15. The device as claimed in claim 14, wherein the tongue is of an elongated shape and is configured such that a length direction of the tongue is parallel with the length direction of the insertion groove when the panel is arranged such that the supporting surface of the first part directly cooperates with the upper surface of the panel.

16. The device as claimed in claim 1, wherein the tongue is of an elongated shape and is configured such that a length direction of the tongue is perpendicular to a displacement direction of the displaceable puncher when the panel is arranged such that the supporting surface of the first part directly cooperates with the upper surface of the panel.

17. A set comprising:

the device as claimed in claim 1; and the panel.

18. A device for inserting a tongue into an insertion groove in a panel, wherein the device comprises a first part comprising a supporting surface configured to directly cooperate with an upper surface of a panel, such that the supporting surface is positioned relative the upper surface of the panel, wherein the device comprises a second part, which is connected to the first part, wherein the second part comprises a displaceable puncher and a guiding device which is configured to guide the displaceable puncher, and wherein the displaceable puncher is configured to displace a tongue into an insertion groove of the panel, wherein a guiding surface of the guiding device intersects a plane of the supporting surface, wherein the supporting surface is extending in a first direction and the guiding device is extending in a second direction, the first direction and the second direction forming a nonzero first angle.

* * * * *